US007517291B2

(12) United States Patent
Waldron

(10) Patent No.: US 7,517,291 B2
(45) Date of Patent: Apr. 14, 2009

(54) BALL GAME PRACTICE DEVICE

(75) Inventor: Christopher J. Waldron, Weybridge (GB)

(73) Assignee: In-Q-Bator Limited, Twickenham, Middlesex (GB)

( * ) Notice: Subject to any disclaimer, the term of this patent is extended or adjusted under 35 U.S.C. 154(b) by 114 days.

(21) Appl. No.: 11/596,017

(22) PCT Filed: May 10, 2005

(86) PCT No.: PCT/GB2005/001787

§ 371 (c)(1),
(2), (4) Date: Nov. 9, 2006

(87) PCT Pub. No.: WO2005/110557

PCT Pub. Date: Nov. 24, 2005

(65) Prior Publication Data

US 2008/0026876 A1 Jan. 31, 2008

(30) Foreign Application Priority Data

May 14, 2004 (GB) ..... 0410741.3

(51) Int. Cl.
*A63B 69/00* (2006.01)

(52) U.S. Cl. ..... 473/427; 473/417; 473/422; 473/429

(58) Field of Classification Search ..... 473/417, 473/422, 423, 429, 459, 139, 145–147, 149
See application file for complete search history.

(56) References Cited

U.S. PATENT DOCUMENTS 2,633,320 A * 3/1953 Salmi ..... 248/123.2
3,794,320 A * 2/1974 Salmont ..... 473/429
3,876,203 A * 4/1975 Gold ..... 473/417
3,924,853 A * 12/1975 Schleeger ..... 473/429
4,105,203 A * 8/1978 Cho ..... 473/429
4,175,744 A * 11/1979 Llewellyn ..... 473/149
4,352,494 A 10/1982 Wells
4,508,339 A * 4/1985 Llewellyn ..... 473/429
4,531,734 A * 7/1985 Herrick ..... 473/429

(Continued)

FOREIGN PATENT DOCUMENTS

WO WO 2005110557 A1 * 11/2005

*Primary Examiner*—Mitra Aryanpour
(74) *Attorney, Agent, or Firm*—Nixon & Vanderhye PC

(57) ABSTRACT

A device (10) for practicing playing a ball game, such as tennis, comprises an arm (29) one end portion of which carries a ball (31), such that the ball (31) is rotatable retained relative to the arm (29), and a remote end portion of which is secured to a face of a toothed pulley wheel (25) which is rotatable mounted on a swingable link means (16, 17, 18) pivotally mounted on a shaft (13). A second, larger, toothed pulley wheel (14) is rotatably mounted on the shaft (13), there being resilient means (23) for restraining such rotation. The toothed pulley wheels (14, 25) are engaged by a toothed endless belt (26). The arrangement is such that, when the arm (29) pivots relative to the axis of rotation of the smaller toothed pulley wheel (25) as a result of the ball (31) being hit in a direction (A), the smaller pulley wheel (25) moves in the same direction and the resultant trajectory of the ball (31) is closer to a typical trajectory of a tennis ball passing over a net in a game over a net in a game of tennis than would be the situation with tennis practice device known hitherto.

7 Claims, 6 Drawing Sheets

Figure 1:
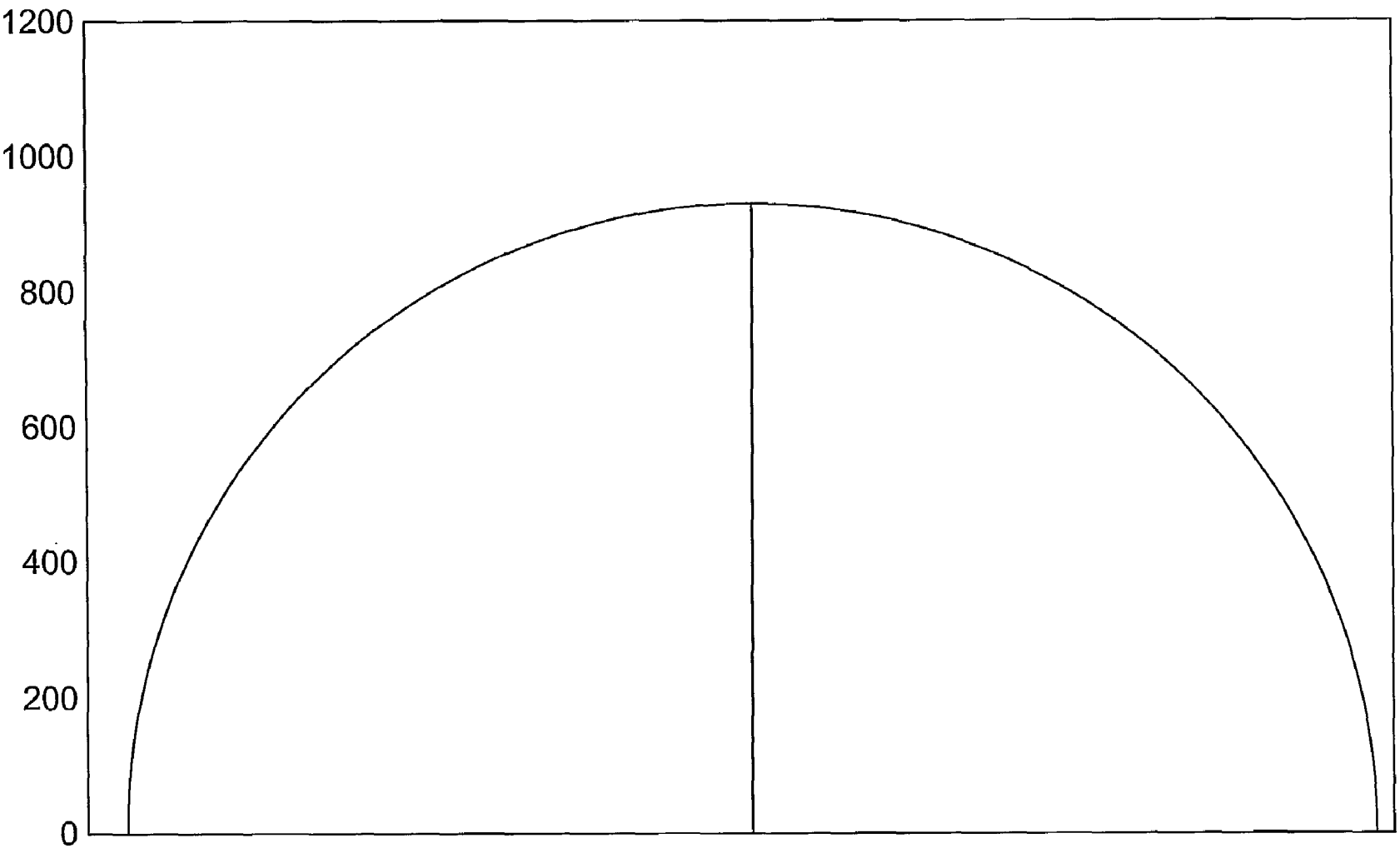
Fig.1 Prior Art

U.S. PATENT DOCUMENTS 5,238,251 A * 8/1993 Staka ..... 473/429
5,499,812 A * 3/1996 Staka et al. ..... 473/149
5,588,655 A * 12/1996 Slupskiy ..... 473/429
5,605,326 A * 2/1997 Spear, Jr. ..... 473/422
5,788,589 A * 8/1998 Koo et al. ..... 473/429
5,957,788 A 9/1999 Eze
6,656,063 B2 * 12/2003 Prichard ..... 473/429
2001/0003106 A1 6/2001 Brenneisen

* cited by examiner

BALL GAME PRACTICE DEVICE

This application is the U.S. national phase of international application PCT/GB2005/001787 filed 10 May 2005 which designated the U.S. and claims benefit of GB 0410741.3, dated 14 May 2004, the entire content of which is hereby incorporated by reference.

This invention relates to a device for practising playing a game in which an oncoming ball is hit by a hand-held implement, such as a racquet.

In U.S. Pat. No. 2,713,487 there is disclosed a tennis practice device comprising an arm one end portion of which carries a ball and a remote end portion of which is adapted to pivot on an axis. A resilient bias is provided so that, after a player has hit the ball with a racquet causing the arm to pivot forwardly on the axis away from the player, the arm is returned to an initial upright position by the resilient bias.

A disadvantage of such a device is that the ball, attached to the arm, moves in an arc through 90 degrees, which does not correspond with the normal trajectory of a tennis ball when hit in a game of tennis.

In FR-A-2,371,213 there is also disclosed a tennis practice device comprising an arm one end portion of which carries a ball and a remote end portion of which is adapted to pivot on an axis and the device also includes a resilient bias for returning the arm to an initial upright position after the ball has been hit. The arrangement is such that the arm is pivotable in a direction rearwardly towards the player as well as forwardly away from the player. The ball, attached to the arm, is thus capable of moving in an arc through 180 degrees. However, such a trajectory still does not correspond with the normal trajectory of a tennis ball when hit in a game of tennis.

The present invention is characterized in that the axis is located on link means whereby, as the arm pivots relative to the axis resulting in the ball moving in a direction, the axis moves in the same direction.

The end portion of the arm carrying the ball thus moves in a trajectory which is not semi-circular but which, when the device in accordance with the present invention is used for practicing playing the game of tennis, more closely follows the trajectory of a tennis ball when hit in such a game compared with tennis practice devices known hitherto.

Following is a description, by way of example only and with reference to the accompanying drawings of one method of carrying the invention into effect.

IN THE DRAWINGS

Figure 2:
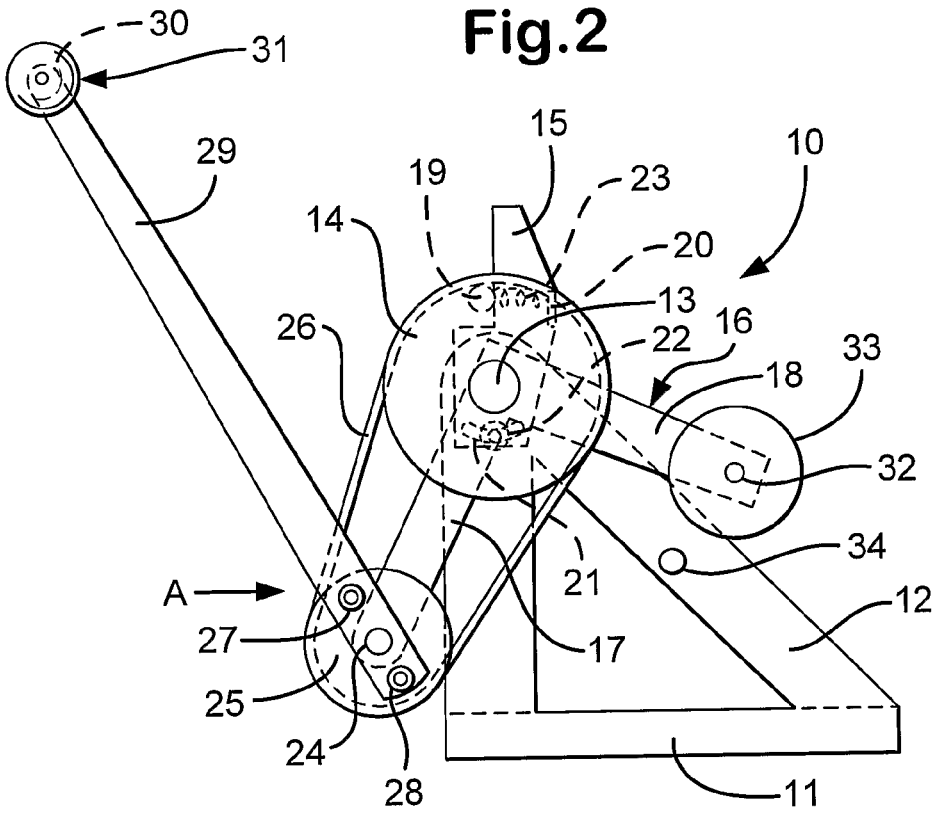
Figure 3:
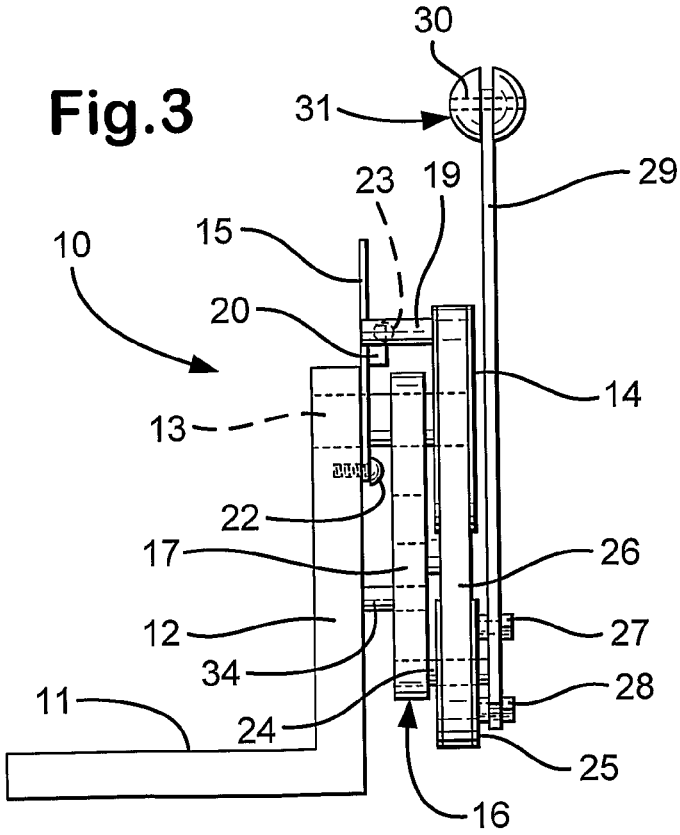
Figure 4:
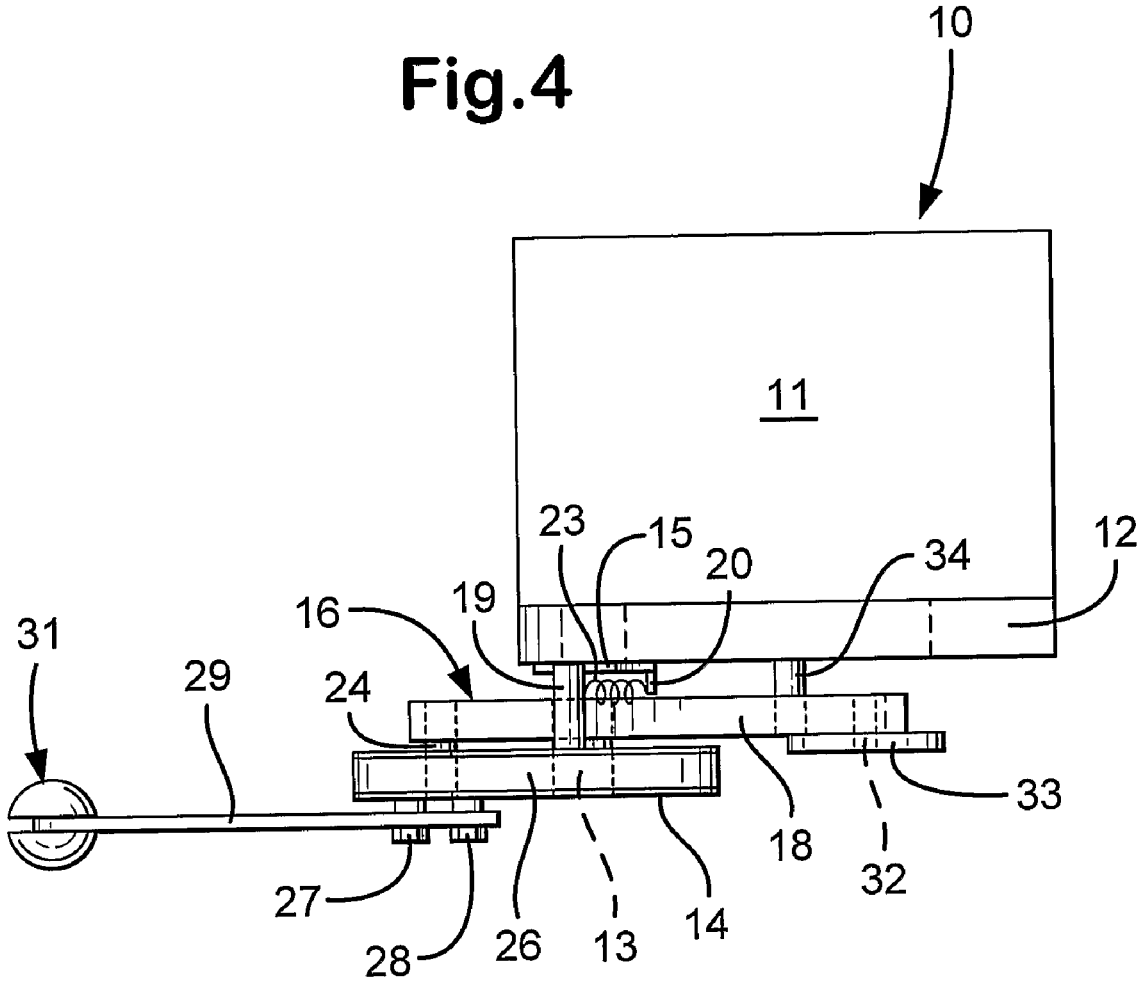
Figure 5:
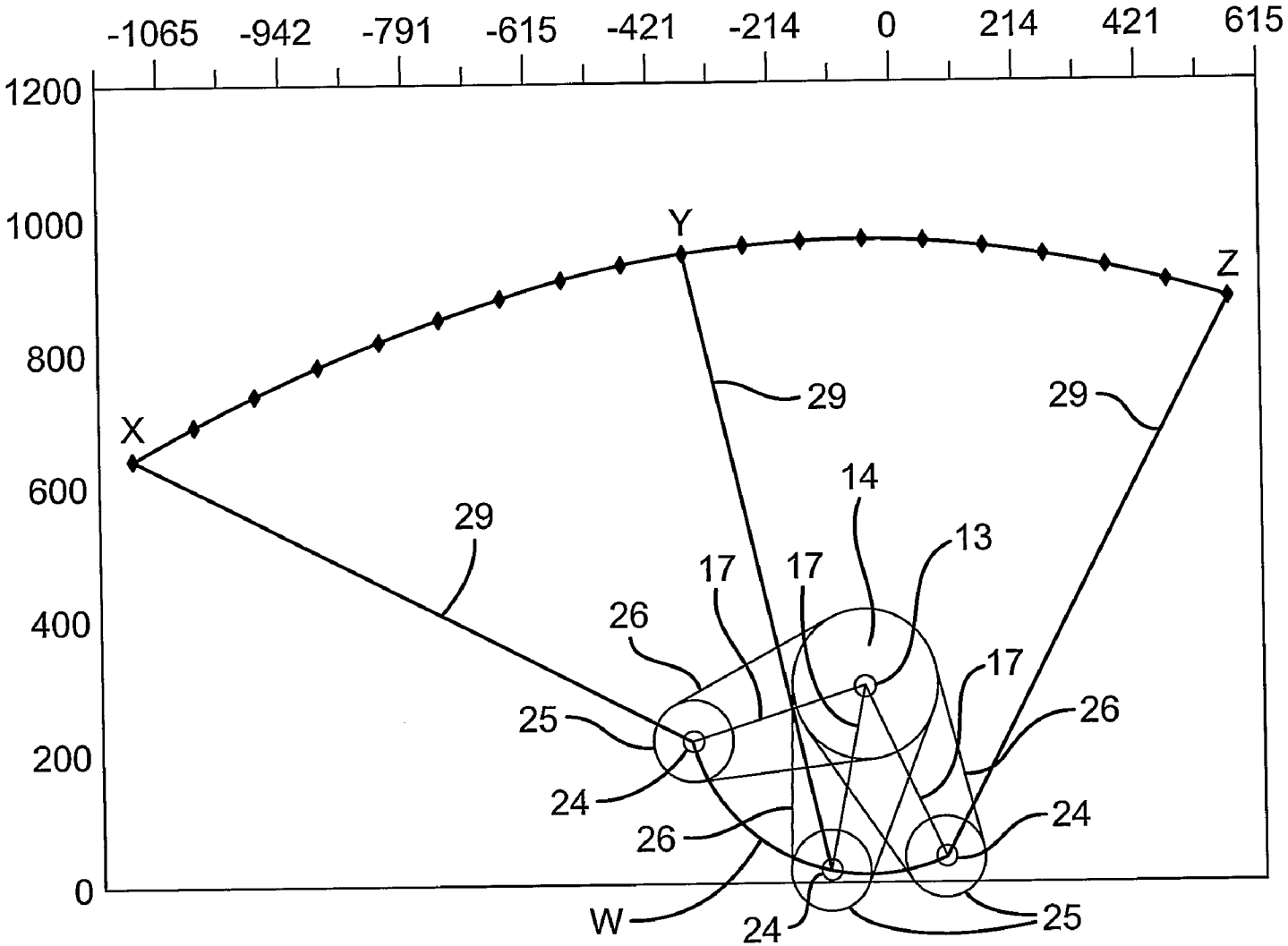
Figure 6:
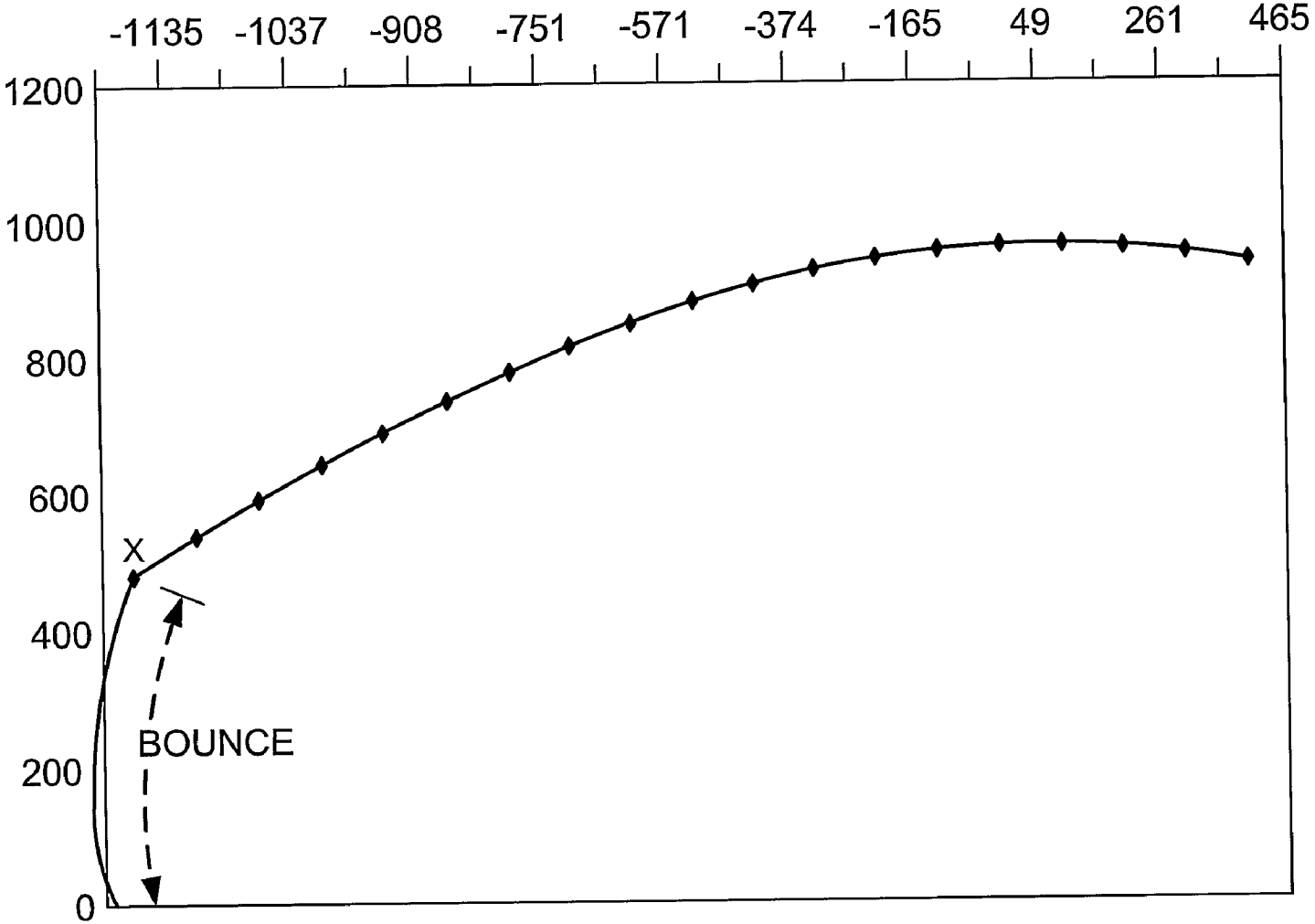
Figure 7:
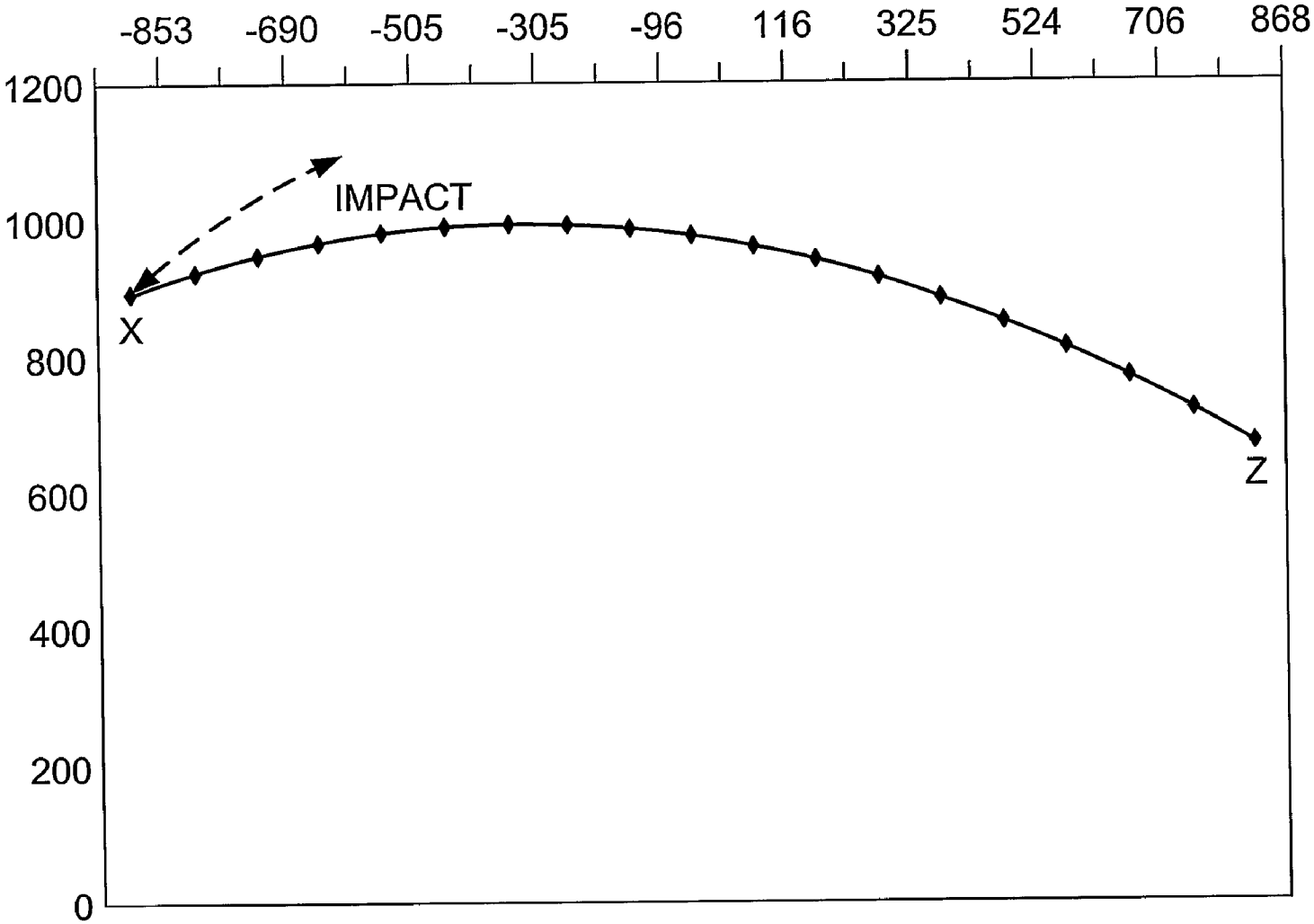

FIG. 1 is a graph showing a typical trajectory of a ball carried at one end of an arm of a tennis practice device known hitherto, FIG. 2 is a side elevation of one embodiment of a ball game practice device in accordance with the present invention, FIG. 3 is an end elevation of the embodiment when viewed in the direction of the arrow 'A' indicated in FIG. 2, FIG. 4 is a plan view of the embodiment shown in FIGS. 2 and 3, FIG. 5 is a graph showing the trajectory of a ball carried at one end of an arm of the embodiment shown in FIGS. 2 to 4, when in use, with zero offset, FIG. 6 is a graph similar to FIG. 5 showing the trajectory with a −10 degree offset, and FIG. 7 is a graph similar to FIGS. 5 and 6 showing the trajectory with a +20 degree offset.

Referring now to FIG. 1 of the drawings, this is a graph showing the trajectory of the ball carried at one end of an arm of a tennis practice device known hitherto, more particularly, a device of the kind disclosed in FR-A-2, 371,213. With such a device, the arm, when in a rest position, extends vertically from a base and a player hits the ball with a racquet forwardly from the rest position. The arm thus pivots forwardly on a pivot axis away from the player and returns towards the player due to the action of a resilient bias included in the device. The player may then again hit the ball forwardly or may decide to step backwards so that the momentum of the return action causes the arm to move towards to player beyond the rest position. If the return movement is of sufficient force, the ball will bounce on a playing surface on which the device is mounted before the player and the player may then wish to hit the ball as it rises from the surface, thereby performing a ground stroke.

As indicated in FIG. 1, the trajectory of the ball of such a device, when in use, is an arc forming part of a circumference of a circle. However, a ball passing over a net in a game of tennis does not move in an arc having such characteristics. In consequence, a device of the kind disclosed in FR-A-2,371, 213, when in use, does not provide a ball which moves in a realistic trajectory.

Referring now to FIGS. 2 to 4 of the drawings, there is shown an embodiment of a ball game practice device 10 in accordance with the present invention. The device 10 comprises a rectangular base 11 and a triangular frame 12 upstanding from one edge margin of the base 11. The frame 12 includes a shaft 13 which is secured to and extends from an apex of the frame 12 such that a longitudinal axis of the shaft 13 extends parallel to the plane of, but extends outwardly from, the base 11.

The shaft 13 has freely located thereon an outer toothed pulley wheel 14, an inner elongate stop plate 15 having an aperture (not shown) for receiving the shaft 13 and, between the pulley wheel 14 and the stop plate 15, a bifurcated link 16 the two arms 17, 18 of which extend at right angles one to another, the link 16 having an aperture (not shown) adjacent the union of the two arms 17, 18 for receiving the shaft 13. The arm 17 will hereinafter be referred to as the 'secondary arm 17' and the arm 18 will hereinafter be referred to as the 'balance arm 18'. The pulley wheel 14 is provided with an axially extending pin 19 located adjacent a circumference of the pulley wheel 14 and extending from the pulley wheel for such distance as to be engageable with an edge face of the stop plate 15. The stop plate 15 is provided with a lug 20, which is bent at right angles to the plane of the plate 15 and, below the aperture for receiving the shaft 13, the stop plate 15 is provided with an arcuate slot 21. The frame 12 is provided with a tapped recess (not shown) in which is received the shank of a grub screw 22, the shank also extending through the arcuate slot 21 of the stop plate 15. The pin 19 of the pulley wheel 14 has connected thereto one end portion of a helical tension spring 23 a remote end portion of which is connected to the lug 20 thereby urging the pin 19 into abutment with the stop plate 15.

An end portion of the secondary arm 17, remote from the union with the balance arm 18, carries a stub shaft 24 extending parallel to the shaft 13 and in a direction outwardly from the base 11 and freely rotatably mounted on the stub shaft 24 is a second toothed pulley wheel 25 of smaller diameter than the first pulley wheel 14. The pulley wheels 14 and 25 are connected one to another by a toothed endless belt 26 the teeth of which engage the teeth of the pulley wheels 14, 25. The smaller pulley wheel 25 has secured to an outer face thereof by means of bolts 27, 28 a lower end portion of an elongate arm 29, hereinafter referred to as the 'primary arm 29', which extends diametrically of the outer face of the smaller pulley wheel 25. An upper end portion of the primary arm 29 is provided with an aperture (not shown) through which extends a shaft 30. The shaft 30 has located thereon a pair of tubular portions (not shown), each co-axial with the shaft 30 so as to be rotatable thereon and the tubular portions being located on opposite sides of the primary arm 29. The tubular portions each have located thereon a corresponding one of a pair of hemispheres formed of soft cellular material and which, together, comprise a ball 31. The shaft 30 is provided with end caps (not shown) for retaining the tubular portions thereon. The ball 31 is thus rotatably mounted on the shaft 30.

An end portion of the balance arm 18 remote from the union with the secondary arm 17 is provided with a stub shaft 32 extending parallel to the shaft 13 and in a direction outwardly from the base 11 and secured to the stub shaft 32 is a weight 33 in the form of a disc. The frame 12 is provided with a pin 34, also extending parallel to the shaft 13 and in a direction outwardly from the base 11, the location of which pin 34 is in the path of the balance arm 18 when the link 16 pivots relative to the axis of the shaft 13. The frame 12 is provided with a tapped recess (not shown) and an end portion of the pin 34 is provided with an external thread (not shown) whereby the pin 34 is removably securable relative to the frame 12.

Before using the device 10, an initial adjustment may be necessary to ensure that the ball 31 is positioned at a predetermined height, the 'striking position', above a playing surface on which the base 11 is located. The striking position is adjusted by loosening the grub screw 22, turning the stop plate 15 relative to the shaft 13 and tightening the grub screw 22. The effect of turning the stop plate 15 relative to the shaft 13 is that there is a consequential turning of the large pulley wheel 14 through a small degree of arc relative to the shaft 13, the movement of the stop plate 15 drawing the pin 19 of the large pulley wheel 14 by the action of the tension spring 23 in one direction or applying a direct force against the pin 19 in an opposite direction. Such turning of the large pulley wheel 14 causes turning of the small pulley wheel 25 on the stub shaft 24, due to consequential movement of the connecting belt 26, resulting in pivoting of the primary arm 29 relative to the axis of the stub shaft 24. The arrangement is such that the 'rest position' of the primary arm 29, i.e. the position that the primary arm 29 will return to when forces applied to the ball 31 have been exhausted, is such that the ball 31 is at the striking position and the balance arm 18 is in abutment with the pin 34.

Referring now to FIG. 5 of the drawings, this is a graph showing the trajectory of the ball 31 when the device 10 is in use with zero offset, i.e. when the stop plate 15 is positioned relative to the frame 12 such that at an interval, during coordinated pivotal movement of the primary and secondary arms 29 and 17, when the secondary arm 17 is vertical, the primary arm 29 is also vertical. When used in this mode, the device 10 simulates the trajectory of the ball 31 moving over a net towards the player in a game of tennis and the striking position would coincide with the point at which the player would return the ball 31 on the volley.

The graph has superimposed thereon, in outline, components of the device 10 including the relative positions of the primary and secondary arms 29 and 17 when the ball 31 is at, respectively, the striking position X, an intermediate position Y and a fully rewound position Z. The values indicated along the left-hand margin of the graph indicate heights in centimeters of the ball 31 from the playing surface and the values indicated along the upper margin of the graph indicate distances in centimeters from a zero position which the ball 31 moves in the trajectory X, Y, Z, the zero position being the position of the ball 31 when the secondary arm 17 is vertical.

When the ball 31 is hit by a racquet at the striking position X in a direction from left to right of FIG. 5, the primary arm 29 pivots in a clockwise direction relative to the longitudinal axis of the stub shaft 24 causing the smaller pulley wheel 25 also to turn in a clockwise direction relative to the same axis. However, the larger pulley wheel 14 is constrained from turning in a clockwise direction on the shaft 13 because of the stop plate 15 blocking the path of the pin 19. Therefore, the reaction of the teeth of the smaller pulley wheel 25 and the teeth of the belt 26 cause the secondary arm 17 to pivot in a counter clockwise direction of the shaft 13 such that the stub shaft 24 moves from left to right of FIG. 5 in an arc W.

In the fully rewound position Z, the balance arm 18 would have moved to an inclined position due to the force applied to the ball 31 but the weight 33 would provide a restoring force which, once the force acting on the ball 31 had exhausted, would cause the balance arm 18 to swing downwardly resulting in the ball 31 moving rearwardly through the trajectory Z, Y, X and the stub shaft 24 moving in the arc W in a reverse direction from right to left in FIG. 5.

In this mode, the pin 34 would be removed from the frame 12 and there would be no force tending to move the pin 19 away from the stop plate 15 against the bias of the tension spring 23.

Referring now to FIG. 6 of the drawings, this is a graph showing the trajectory of the ball 31 of the device 10 when in use with a −10 degree offset, i.e. when the stop plate 15 is positioned relative to the frame 12 such that at an interval during coordinated pivotal movement of the primary and secondary arms 29 and 17, when the secondary arm 17 is vertical, the primary arm 29 is positioned 10 degrees from vertical in a direction counter clockwise when viewed in FIG. 2.

In this mode, the device 10 is adapted for entry-level tennis players in that the striking position X is closer to the playing surface than in the mode represented in FIG. 5. Furthermore, in this mode, the arrangement provides for bouncing of the ball 31 off the playing surface up to the striking position X, thereby simulating the practice carried out by many tennis coaches which involves dropping a tennis ball from a low height and encouraging young entry-level players to hit the ball with a tennis racquet as the ball rises from the playing surface. In this mode, the pin 34 is located on the frame 21 and the arrangement is such that, as the primary arm 29 returns from a rewind position Z, the balance arm 18 will engage the pin 34. This will occur approximately when the ball 31 arrives at the striking position X. However, there will be some considerable momentum present in the pivoting primary arm 29 and this will carry the ball 31 beyond the striking position X, such movement being possible because rotative motion of the large pulley wheel 14 in a counter clockwise direction of the shaft 13, when viewed in FIG. 2, can be accommodated within the constraint of the tension spring 23. After the ball has bounced on the playing surface, the effect of the spring 23 will cause the large pulley wheel 14 to be turned in a clockwise direction of the shaft 13, when viewed in FIG. 2, such that the pin 19 will again be urged into contact with the stop plate 15 and the ball 31 will be returned to the striking position X. The rotative motion of the primary arm 29 will result in a near vertical 'bounce' of the ball 31.

Referring now to FIG. 7 of the drawings, this is a graph showing the trajectory of the ball 31 of the device 10 when in use with a +20 degree offset, i.e. when the stop plate 15 is positioned relative to the frame 12 such that at an interval during coordinated pivotal movement of the primary and secondary arms 29 and 17, when the secondary arm 17 is vertical, the primary arm 29 is positioned 20 degrees from the vertical in a direction clockwise when viewed in FIG. 2. In this mode, it is necessary to deconstruct the components and re-assemble them so that the pin 19 is positioned to the right of the lug 20, when viewed in FIG. 2, preventing counter-clockwise rotation but permitting clockwise rotation of the large pulley wheel 14, although the tension spring 23 will still link the pin 19 and the lug 20. Also in this mode, the pin 34 is removed from the frame 12.

In this mode, the striking position X will be a greater distance from the playing surface compared with the modes represented in FIGS. 5 and 6 and the device 10, when used in this mode, will be suitable for practicing ground shots, the ball 31 moving towards the player as if having 'bounced' at a rewind position Z. The tension spring 23 will also have the effect of absorbing initial impact when the ball 31 is struck.

Also in this mode, means may be incorporated for detecting extension of the tension spring 23 and triggering a rewind system (not shown) operation of which would cause the primary arm 29 to be moved to the rewind position Z shown in FIGS. 5, 6 and 7 before releasing it to launch the ball 31 back to the striking position X under the action of the weight 33. The rewind system may include a timing device for selectively effecting release of the primary arm 29. The detection means additionally, or separately, may be adapted to operate a counting and/or a voice generating system.

It will be appreciated that the weight 33 may be substituted by a heavier or a less heavy weight so as to vary the speed of return of the ball 31.

It will also be appreciated that the primary and secondary arms 29 and 17 may each be adjustable in length so as to vary the trajectory of the ball 31. The same objective may be achieved by substituting the pulley wheels 14 and 25 with pulley wheels having different respective diameters to the pulley wheels 14 and 25.

It will also be appreciated that two devices 10 may be positioned to operate so that a player may train in the use of fore-hand and back-hand play alternately or at random.

It will also be appreciated that means may be included for indicating statistics, such as the number of "good" returns achieved in a period.

It will also be appreciated that the base 11 may be provided with spikes so that the base 11 may be more firmly secured on a playing surface.

The invention claimed is:

1. A ball game practice device comprising:

a frame, a link suspended on the frame for pivotal movement on a first axis, an arm one end portion of which carries a ball and a remote end portion of which is connected to the link so as to pivot on a second axis, which passes through the link and the arm, and a transmission assembly which transmits movement of the arm in a rotative direction relative to the second axis to movement of the link in a counter-rotative direction relative to the first axis whereby, when the ball is struck by a player thereby effecting such movement of the arm, the ball moves in a predetermined trajectory extending away from and in line with the player, the distance of travel of the ball being substantially the sum of the length of the link and the length of the arm.

2. A device as claimed in claim 1, wherein the link includes an assembly of toothed pulley wheels and a toothed endless belt extending in engagement with the wheels.

3. A device as claimed in claim 2, wherein rotative motion of one of the wheels is resiliently restrained.

4. A device as claimed in claim 3, wherein the rotative motion is adjustable so as to vary the trajectory.

5. A device as claimed in claim 1, wherein the link comprises a bifurcated member.

6. A device as claimed in claim 5, wherein the bifurcated member includes a balance arm which carries a weight.

7. A device as claimed in claim 1, further comprising a rewinder which rewinds the arm relative to the second axis.

* * * * *